United States Patent [19]

Clayton et al.

[11] Patent Number: 4,751,813

[45] Date of Patent: Jun. 21, 1988

[54] PNEUMATIC YARN SPLICING EQUIPMENT

[75] Inventors: James W. B. Clayton, Gwent; David T. A. Fuller, Glamorgan, both of Wales

[73] Assignee: Pentwyn Precision Ltd., Great Britain

[21] Appl. No.: 806,273

[22] Filed: Dec. 6, 1985

[30] Foreign Application Priority Data

Dec. 10, 1984 [GB] United Kingdom ..... 8431093

[51] Int. Cl.[4] ..... D01H 17/00

[52] U.S. Cl. ..... 57/22

[58] Field of Search ..... 57/22, 261; 30/228

[56] References Cited

U.S. PATENT DOCUMENTS 3,477,217 11/1969 Bell et al. ..... 57/22

*Primary Examiner*—Douglas D. Watts

*Attorney, Agent, or Firm*—Allegretti, Newitt, Witcoff & McAndrews, Ltd.

[57] ABSTRACT

A slot forming a splicing chamber is closed by sliding action between contacting surfaces of two bodies linked at a point which is perpendicularly spaced from both surfaces. The closure surface comprises the crown of a piston. The piston has a central orifice and is slidable in a bore in one of the bodies to which pressurized air is admitted. When the chamber is closed the orifice registers with the slot and allows a blast of air to pass from the bore into the slot.

12 Claims, 7 Drawing Sheets

PNEUMATIC YARN SPLICING EQUIPMENT

This invention relates to yarn splicing devices and in particular to pneumatic chambers therefor. Known prior art yarn splicers having pneumatic chambers are normally provided with a splicing chamber which has a hinged lid. By this it is meant that the lid is normally arranged so that it closes onto the splicing chamber with a hinging action, the chamber being a slot or depression into which the threads to be spliced are laid. It is also usual in these splicers for the air which provides the splicing action to be admitted into the chamber through a wall of the body defining the chamber rather than through the lid, because this provides the simplest mechanical arrangement. It is also found in the prior art that the mechanical operations of the splicer are performed by pneumatic action.

BRIEF DESCRIPTION OF THE INVENTION

The device of the invention is particularly distinguished from its predecessors by the fact that the closure member closes the splicing chamber by a sliding operation. In the preferred arrangement this is facilitated by constructing the closure member in the form of a pneumatic piston which is urged into contact with the body forming the splicing chamber by a suitable air pressure. The piston is provided at its centre with an orifice which releases a blast of air into the pneumatic chamber when it comes into registration therewith. The device is manually actuated and has very few parts to cause problems. The use of a sliding closure member and in particular the use of the pneumatic piston enables an arrangement to be provided which allows easy access to the splicing chamber when preparing the splice and avoids the use of fragile members and complicated linkages.

Thus it is a main object of the invention to provide a pneumatic yarn splicer in which the closure of the splicing chamber is achieved by a sliding action of the closure member. According to the invention such a splicer comprises first and second bodies having respective complementary surfaces which slide relative to and in contact with one another from an open to a closed condition of the splicer and which co-operate so as to provide a pneumatic splicing chamber which is open in said open condition and closed in said closed condition, said chamber being defined by a slot which is open at each end in the said surface of a first one of said bodies and a closure surface on the complementary surface of the second body, and air supply means, including air passage means and an orifice in one of said bodies, arranged so as to admit air under pressure into the said splicing chamber when the chamber is closed.

The invention also provides a pneumatic yarn splicer comprising first and second bodies which are joined at a pivot so as to be relatively angularly displaceable between a relatively wide-angle disposition corresponding to an open condition of the splicer, and a narrower-angle disposition corresponding to a closed condition of the splicer, in which the two bodies have complementary surfaces which co-operate to define a pneumatic splicing chamber into which a blast of air is admitted, said chamber being formed by a slot in a face of a first one of the bodies and a closure surface on the second body, said slot in said first body being open at both ends so as to receive the yarns to be joined, one from each direction, and to enable the spliced yarn to be removed when the splicer is in its open condition, and to exhaust the blast of air when the splicer is in its closed condition, characterised in that the said pivot is situated in a plane which is substantially normal to the face containing the slot and is spaced apart therefrom such that the said complementary surfaces slide in contact, relative to one another, between said open and said closed conditions. In the preferred arrangement the body containing the said slot has a part adapted to be held stationary relative to the operator, and the body providing the closure member contains an orifice coupled to an air supply which registers with the slot when the device is closed and admits a blast of air into the slot.

The invention also provides an improvement by means of which the threads before being spliced are detwisted and after splicing the twist is restored to the spliced thread.

BRIEF DESCRIPTION OF THE DRAWINGS

These and other objects and improvements of the invention are illustrated by way of example in the accompanying drawings, in which.

Figure 1:
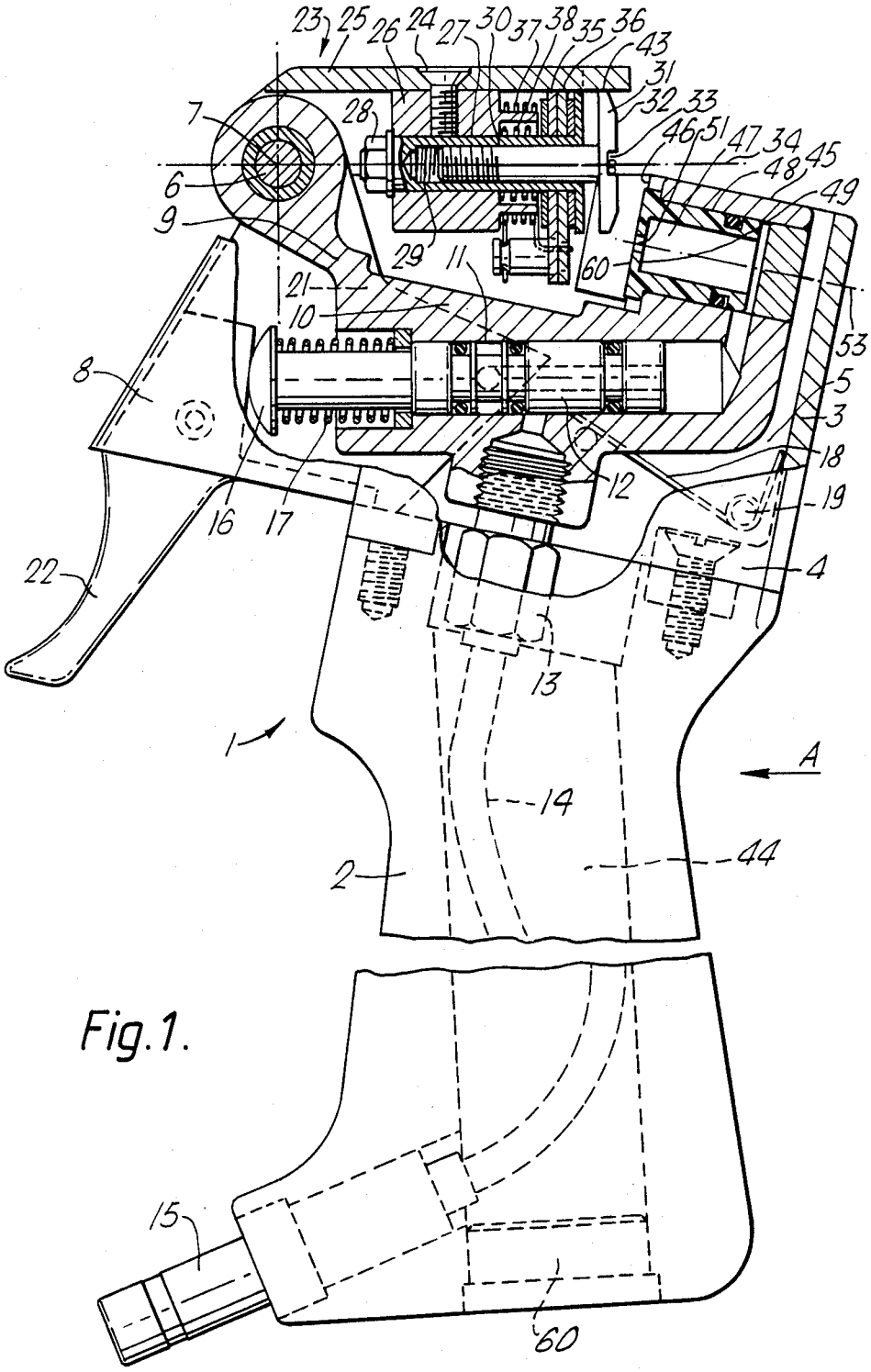
FIG. 1 is a part-section side view of the splicer according to the invention in a condition ready to perform a splicing operation.

The embodiment of the invention disclosed in FIGS. 1 to 4 comprises a threaded splicer body 1 which is formed to be held in the hand, having a lower portion 2 defining and shaped as a hand grip and an upper open casing 3 having side walls 4, 5. A pivot pin 6 supported by the side walls 4, 5, defines a pivotal axis 7 and is positioned at the top and rear of the splicer body 1. Mounted on the pivot pin 6 within the casing 3 for independent, limited, angular movement in an anti-clockwise direction from the position shown in FIG. 1 is an actuating lever 8 which extends downwards from the pivot pin 6 and a crank shaped spool valve body 9 having an elongate intermediate portion 10 between a cranked end portion mounted on the pivot pin 6 and a free end. The intermediate portion 10 of the spool valve body houses a conventional pneumatic spool valve 11 including a spool member 12. An air pressure supply is coupled to the spool valve 11 through a union 13 on the base of the spool valve body 9, through a flexible air hose 14 which passes through a bore 44 in the splicer body and through a coupling 15 provided in an axially offset position at the bottom end of the hand grip portion 2. Spool member 12 extends towards lever 8 outside the spool valve body 9 to form an actuator 16 which co-operates with an intermediate portion provided on the lever 8. Actuator 16 is biased towards lever 8 by means of a spring 17. Spool valve body 10 is biased downwards (clockwise as shown in FIG. 1) by means of a torsion spring 18 mounted on a pin 19 which passes through the casing. Bore 44 is closed by means of a blanking plug 60.

Actuating lever 8 is provided with bifurcated arms which extend upwards to provide pivot bearings in which the pivot pin is journalled and which also extend into the casing 3 on either side of of the spool valve body 9 to form scissor actuating members 20, 21 for actuating a scissor mechanism, described hereinafter. Lever 8 extends downwards out of said housing at an angle to the hand grip to form a manual operator 22 (called hereinafter "the trigger 22").

A head assembly 23 is mounted on the casing by means of the pivot pin 6 for angular displacement relative to the casing but is normally secured thereto by a captive screw (not shown). Head assembly 23 comprises a cap 25 which is articulated to the pivot pin 6 and a removable cartridge 26 which is fastened on the underside of the cap by means of a screw 24. Cartridge 26 mounts a cylindrical sleeve 27 which is secured in the cartridge body by fastening means 28. Cylindrical sleeve 27 has a screw-threaded bore 29 which contains a correspondingly screw-threaded member 30 (also called herein the pneumatic chamber body 30). This member is provided with an external head portion 31 defining an end face 32 which is substantially curved in the vertical plane and which bears a slot 33 along a line which passes through the common axis 34 of said member and said sleeve, said slot being normally arranged parallel with the pivotal axis 7 of the pivot pin 6. This slot 33 comprises the pneumatic chamber of the splicer. Axis 34 of the pneumatic chamber body 30 intersects the pivotal axis 7 of the pivot pin 6.

Figure 2:
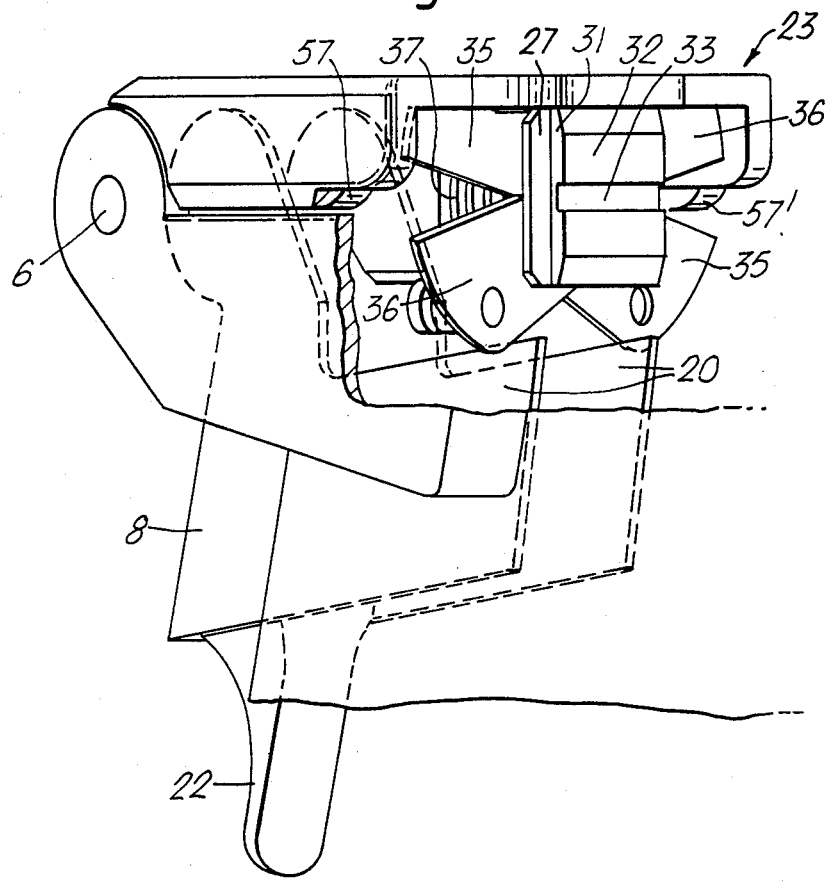
FIG. 2 is a bit drawing of the casing with the latter broken away in part to show the scissor mechanism.

As best seen in FIG. 2, cylindrical sleeve 27 extends from the cartridge 26 to provide an outer cylindrical bearing surface on which are mounted two pivotable scissor blade members 35, 36. The latter are biased in opposite angular directions by means of springs 37, 38, so that scissors formed by the scissor blades are normally in an open condition. Each scissor blade member is mounted on said sleeve near its mid-point and defines an upper blade 39, 40, which normally abuts the underside of the cap 25 and a diametrically opposite lower blade 41, 42 which extends downwards towards the scissor actuating members 20, 21. On each respective side of the casing each top and bottom blade co-operate to form a pair of scissors. The external head portion 31 of the pneumatic chamber body 30 is formed with flat sides 43 parallel to the slot 33, one of which is arranged to abut the underside of the cap 25 so as to prevent rotational movement of the chamber body in the sleeve 27. Axial adjustment of the scissors relative to the splicing chamber is obtained by removing the cartridge 26 from the cap 25 (or by slackening off its fastening means 24 sufficiently) and rotating the chamber body in the sleeve in the appropriate direction. The cartridge is then once more secured to the cap.

Spool valve body 9 extends away from the pivot pin 6 beyond the intermediate portion to a boss 45 defining an upstanding end face 46 facing towards the pivot pin. A blast chamber 47 comprising a cylindrical bore in the boss 45 which enters from the end face 46 contains a piston 48 having a cylindrical portion which is slidable within the said bore and a crown 49 which normally projects from the bore. Crown 49 has a planar surface 50 which is parallel to the end face 46 and has an orifice 51 at the centre thereof which communicates with the interior of the blast chamber. An O-ring provided on the cylindrical portion of the piston provides an air seal therefor.

The casing 3 and the spool valve body 9 are dimensioned so that when the spool valve body is rotated in an upward direction (anticlockwise as shown in FIG. 1) by the full extent permitted by the head assembly 23, the common axis 53 of the piston and the blast chamber forms an extension of the axis 34 of the pneumatic chamber body, whilst the end face 46 of the boss 45 is spaced sufficiently far away from the pivot pin 6 to allow the crown of the piston to ride over the end face 32 of the chamber body, as the spool valve body rotates, from a position where it engages only the bottom curved edge of said end face 32.

Friction-gripping members 54, 55 for the running ends of each of the threads which are to be joined are provided on the external faces of the side plates 4, 5. Further friction-gripping means for gripping the free ends of the threads, are defined by friction surfaces 56, 56', provided on the downward facing side edges of the cap 25 and by spring biased arms 57, 57' positioned within the casing which are pivotally mounted on the pivot pin 6.

Where facilities for automatic operation exist, the casing complete with the splicing head can be separated from the hand grip portion and mounted directly on a mule or other textile apparatus. The trigger 22 is preferably dismountable from the lever 8, actuation being provided by means of a push rod or rotating cam.

Figure 3:
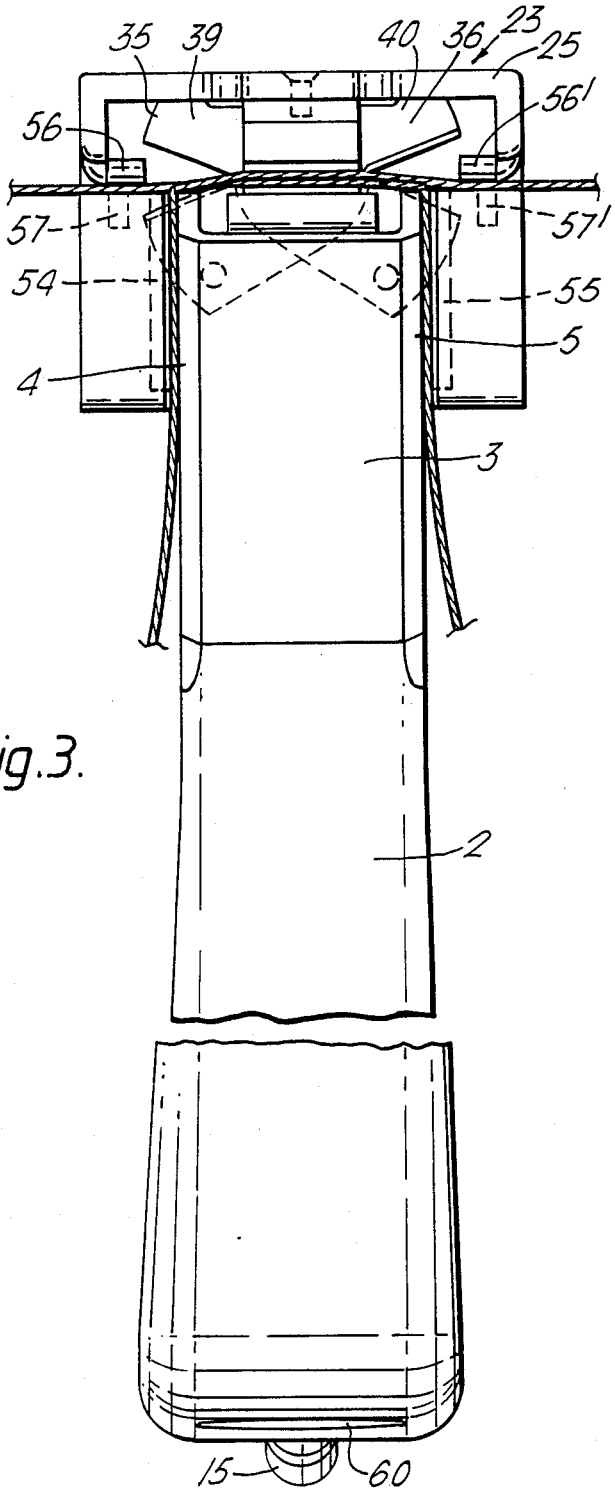
FIG. 3 is a view of the splicer of FIG. 1 from the direction of the arrow A shown in FIG. 1.
Figure 4:
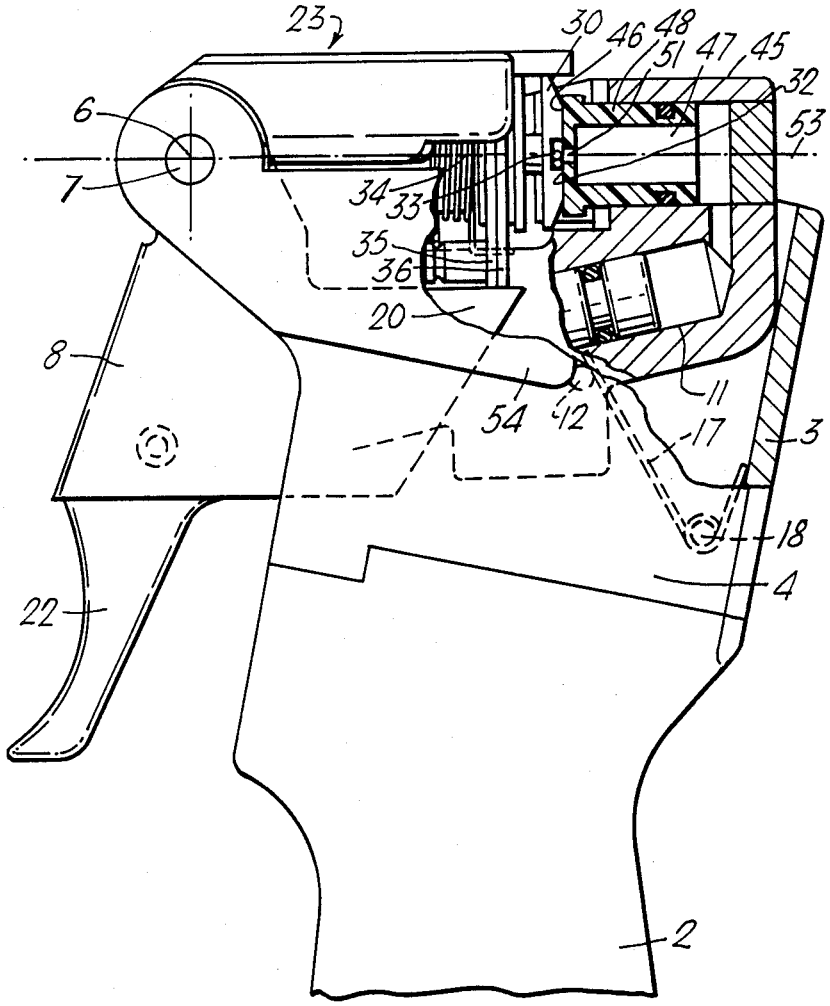
FIG. 4 is a side part-sectional view of the splicer which has been actuated and is about to perform the splicing operation.

When using the device, air pressure is admitted thereto and, as shown particularly in FIG. 3, the threads to be spliced are laid longitudinally in the slot 33 forming the splicing chamber, one from each direction, with the free (i.e. broken) ends thereof being threaded back from the chamber body through the tripping means 56, 57, and through the respective pairs of scissors along a plane which more or less contains the axis of the pivot pin 6. The running threads are taken vertically down from the slot 33 through the respective gripping members 54, 55 on each side of the casing.

With this simple loading process completed the trigger 22 is then squeezed towards the hand grip with a first pressure so that the intermediate portion of lever 8 presses against the spool valve actuator 16. This pressure is transmitted to the spool valve body 10 through the spring 17, causing the body to pivot upwards until the scissor actuating members 20, 21 formed on lever 8 contact the depending lower portions of the two scissor blade members 35, 36, further movement of the lever being then resisted by the scissor springs 37, 38. During this movement of the spool valve body the boss 45 is moved up to the position shown in FIG. 4 in which its end face 46 confronts the end face 32 of the chamber body and the crown of the piston slides over the end face 32 of the chamber body in contact therewith until the axis 7 of pivot pin 6, the axis of the chamber body 30 and the common axis of the blast chamber 47 and piston 48 all lie in the same plane, at which position the chamber is closed and the orifice 51 in the crown of the piston is exactly in registration with the splicing chamber. This initial pressure on the trigger 22 causes the actuator 16 to move slightly into the spool valve body, thereby bleeding some air to the blast chamber and ensuring that the piston 48 extends therefrom into contact with the end face 32 of the chamber body.

Further manual pressure applied to the trigger 22 causes the scissor actuating members 20, 21 formed on the lever 8 to force the spring blades to pivot against the bias of their respective springs thereby severing the ends of the threads. A final pressure applied to the trigger 22 causes the full depression of the actuator which in turn releases a blast of air into the splicing chamber.

When the trigger is released the force exerted by the scissors springs opens the scissors until their upper blades abut the underside of the cap 25, and pushes the scissor actuating members 20, 21 downwards, rotating the lever 8 clockwise. This movement releases the actuator 16 which is moved out of the spool valve body 9 to its rest position by the spring 17. The spool valve body 9 is pushed downwards by the torsion spring 18 to its limiting position as seen in FIG. 1, which movement is transmitted to the lever 8 by the spring 17. In this final condition the blast chamber is isolated from the air pressure and is therefore exhausted to atmosphere and the splicing chamber (slot 33) is fully exposed, allowing the spliced thread to be removed.

Figure 5:
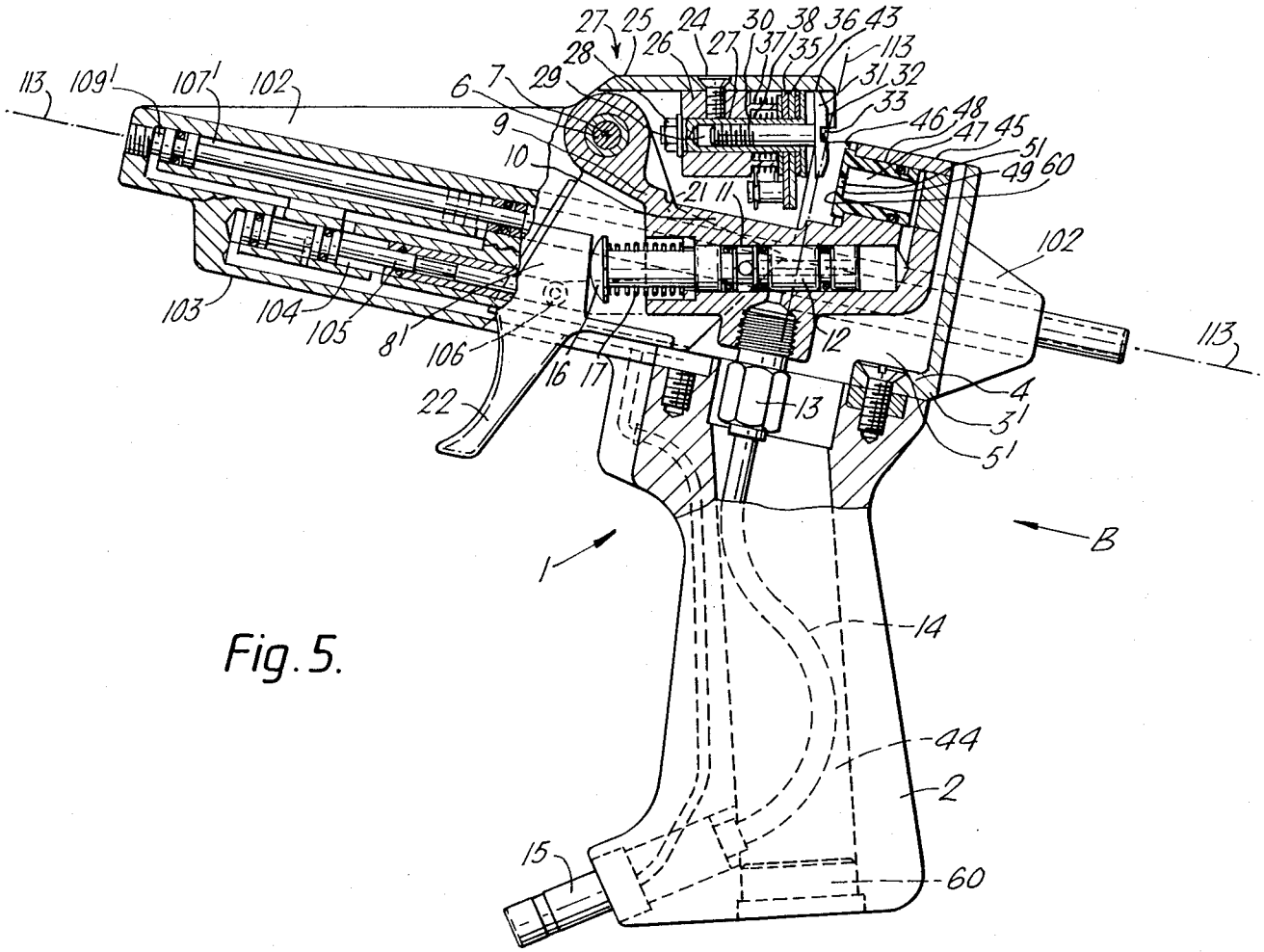
FIG. 5 is a part sectional side view of a modification of the invention of FIG. 1, in which the section planes correspond to the planes I, I indicated in FIG. 6.
Figure 6:
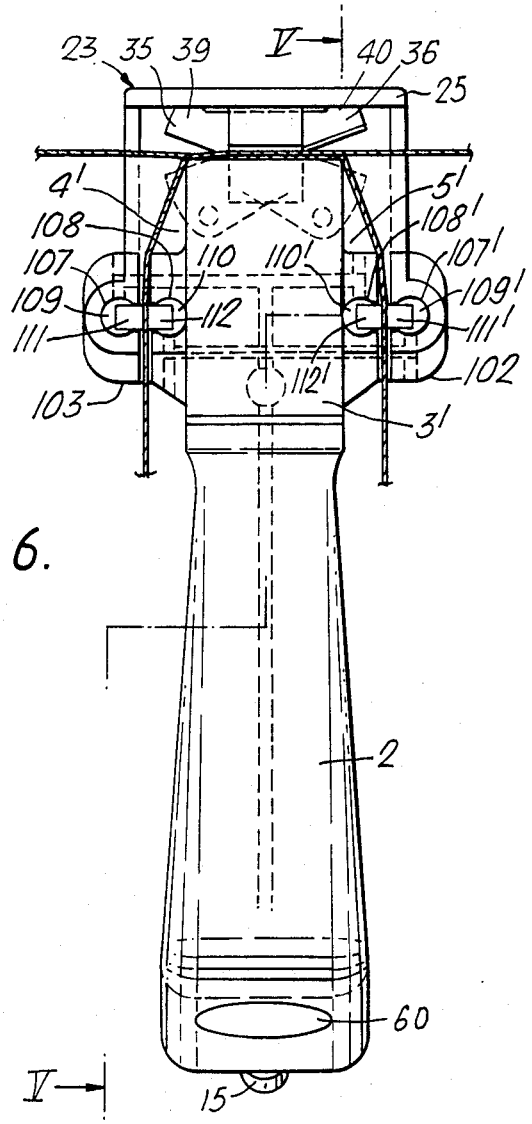
FIG. 6 is a view of the splicer from the direction of the arrow B shown in FIG. 5.

A modification of the embodiment previously described is illustrated in FIGS. 5 and 6. The splicing chamber and mechanisms directly associated therewith and the lower portion of the device are substantially identical to the construction of the first embodiment and are not further described. The open casing is now referred to as 3', the respective side walls are referred to as 4', 5', and the respective actuating lever is referred to as 8'. In this modification the previous friction-gripping members used to grip the running threads during the splicing operation which were provided on the side walls are replaced by appendages 101, 102, integral with side walls 4', 5', which extend behind the splicer on both sides thereof. The casing 3' has an added portion 103 which extends rearward between the said appendages 101, 102. This added portion houses a second spool valve 104 having a spool member 105 which extends to and is articulated on the lever 8' at a pivot 106.

Figure 7:
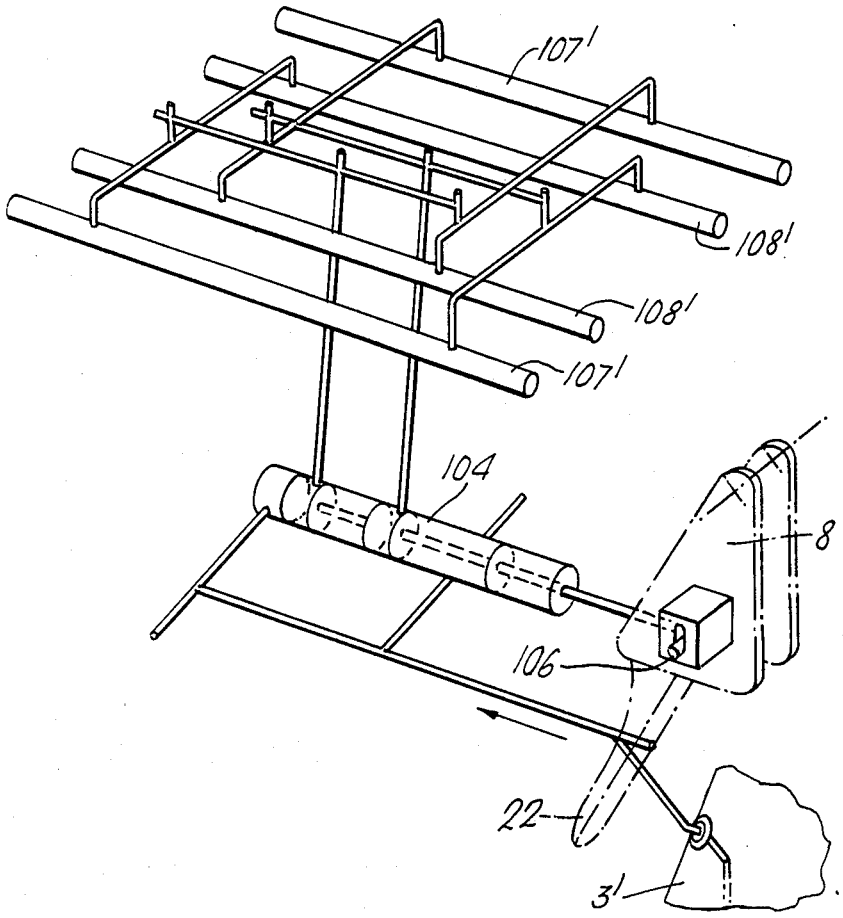
FIG. 7 is a schematic diagram referring to FIG. 5 showing the couplings between the pneumatic cylinders and the second spool valve and between the latter and the body of the splicer.

Each of the said appendages contains two, parallel, closely adjacent bores 107, 108 (107', 108') having axes which lie in a common plane 113 parallel with the axis of the pivot pin 6, which bores comprise pneumatic cylinders of equal strokes. Each bore contains in the portion thereof which extends rearward of the casing, a piston 109, 110 (109', 110') each having conventional O-ring seals. Each piston has an integrally formed elongate linear extension having an axially offset co-extensive insert 111, 112 (111', 112') of rectangular cross-section, said extensions extending from the piston in a forward direction. These extensions are substantially of equal length. On each side of the casing the bores are terminated by open ends shortly behind the plane 113 perpendicular to the bore axes containing the slot forming the splicing chamber. The spool valve 104 is designed to supply pressurized air through internal ducts in the casing 3' (see FIG. 7) to provide a first set of conditions in said cylinders, before actuation of the splicer, in which the pistons 110, 110' within the inner bores on each side of the casing 3' are positioned at their foremost extent of their travels within the respective bores and the pistons 109, 109' within the outer bores on each side of the casing 3' are positioned at their rearmost extent of their travels in the respective bores. When the trigger 22 is squeezed during operation of the splicer the spool valve 104 is actuated to provide a second set of conditions in said cylinders in which each piston is displaced to the other end of its respective bore.

The pistons and their extensions are dimensioned such that when they are in their rearmost positions in their respective bores their extensions extend slightly forward of the aforesaid plane 113 and when the pistons are in their foremost positions the ends of their respective extensions adjoining the pneumatically operative parts of the respective pistons extend to positions which are behind the aforesaid plane. Moreover, the extensions of the pairs of pistons in the adjacent bores are arranged so that their mutually facing sides are spaced apart only sufficiently to admit and grip a thread. These sides are provided with friction surfaces. Thus in the first condition substantially the whole length of the aforesaid extensions of the inner pistons extend forward of the splicing chamber whilst the extensions of the outer pistons extend substantially over the whole of their length behind the splicing chamber and, in the second condition the reverse situation obtains, in which the extensions of the inner pistons are placed substantially over the whole of their length behind the splicing chamber and the extensions of the outer pistons extend substantially over the whole of their length in front of the splicing chamber. In both conditions portions of adjacent faces of the extensions overlap. Thus in said first condition the arrangement is such that on each side of the housing a forward-facing, vertical, open slot is provided between the respective two extensions of the pistons, the face of the slot being slightly forward of said plane 113 containing the splicing chamber. Into these slots the running portions of the threads are inserted, care being taken to ensure that the said running threads are placed in the splicer from the appropriate directions for the operation which is to follow. The pneumatic connections between the second spool valve 104 and the cylinders 107, 107', 108, 108' and the pneumatic and the mechanical connections between the said second spool valve and corresponding elements on the casing 3' of the splicer are shown diagramatically in FIG. 7. The air passages indicated therein are formed by drillings in the walls of appendages 101, 102 and added portion 103 of the casing.

When the trigger is squeezed during operation of the splicer the pistons on each side are moved in opposite directions which has the effect of untwisting the thread on each side. When the trigger is released, after the splicing operation has been completed, the pistons are returned by the air pressure to their first conditioms with the consequence that the twist is restored to the spliced thread.

The embodiments hereinbefore described produce the sliding closure of the splicing chamber by a co-operative movement of two relatively elongate bodies which are linked together. It will be understood by skilled practitioners in the art that a similar closure may be obtained between a cylindrical sleeve and a concentric cylindrical body. Moreover a sliding closure of the chamber by means of a rectilinearly moving body is considered to be within the spirit of the invention, the scope of which is defined by the appended claims.

We claim:

1. In a pneumatic yarn splicer comprising first and second bodies which are joined at a pivot so as to be relatively angularly displaceable between a relatively wide-angle disposition corresponding to an open condition of the splicer, and a narrower-angle disposition corresponding to a closed condition of the splicer, in which the two bodies have complementary surfaces which are juxtaposed in said closed condition and co-operate to define a pneumatic splicing chamber into which a blast of air is admitted, said chamber being formed by a slot in a face of the first body and a closure surface on the second body, said slot in said first body being open at both ends so as to receive the yarns to be joined, one from each direction, and to enable the spliced yarn to be removed when the splicer is in its open condition, and to exhaust the blast of air when the splicer is in its closed condition, the improvement in which the surface on the first body faces radially outward from the pivot and the surface on the second body faces radially inward to the pivot, the surfaces both being substantially the same perpendicular distance from the pivot such that the surfaces are in sliding contact with each other as the splicer moves between its open and closed conditions.

2. A pneumatic splicer according to claim 1 wherein said blast of air enters the splicing chamber through an orifice in said closure surface of said second body.

3. A pneumatic splicer comprising first and second bodies which are joined at a pivot so as to be relatively angularly displaceable between a relatively wide-angle disposition corresponding to an open condition of the splicer, and a narrower-angle disposition corresponding to a closed condition of the splicer, in which the two bodies have complementary surfaces which are juxtaposed in said closed condition and co-operate to define a pneumatic splicing chamber into which a blast of air is admitted, said splicing chamber being formed by a slot in a face of the first body and a closure surface on the second body, said slot in said first body being open at both ends to as to receive the yarns to be joined, one from each direction, and to enable the spliced yarn to be removed when the splicer is in its open condition, and to exhaust the blast of air when the splicer is in its closed condition, wherein the surface on the first body faces radially outward from the pivot and the surface on the second body faces radially inward to the pivot, the surfaces both being substantially the same perpendicular distance from the pivot such that the surfaces are in sliding contact with each other as the splicer moves between its open and closed conditions, and wherein said second body contains a pneumatic valve means having an actuator which co-operates with a manual operator and a blase chamber means connected via air passage means to said pneumatic valve means, said blast chamber means including a blast chamber and a piston the crown of which defines said closure surface, said piston having a coaxial orifice in said crown which, when said splicing chamber is closed by the piston, registers with the said slot in said first body, said actuator when actuated moving said first body so as to close the splicing chamber and operating said pneumatic valve means so that in a first phase of operation air is bled into the blast chamber so as to cause the piston to bear against the surface of the first body which contains the slot and in a second phase of operation causes a blast of air to be transmitted through the blast chamber and via the orifice in the piston into the splicing chamber.

4. A pneumatic splicer comprising first and second bodies which are joined at a pivot so as to be relatively angularly displaceable between a relatively wide-angle disposition corresponding to an open condition of the splicer, and a narrower-angle disposition corresponding to a closed condition of the splicer, in which the two bodies have complementary surfaces which are juxtaposed in said closed condition and co-operate to define a pneumatic splicing chamber into which a blast of air is admitted, said splicing chamber being formed by a slot in a face of the first body and a closure surface on the second body, said slot in said first body being open at both ends so as to receive the yarns to be joined, one from each direction, and to enable the spliced yarn to be removed when the splicer is in its open condition, and to exhaust the blast of air when the splicer is in its closed condition, wherein the surface on the first body faces radially outward from the pivot and the surface on the second body faces radially inward to the pivot, the surfaces both being substantially the same perpendicular distance from the pivot such that the surfaces are in sliding contact with each other as the splicer moves between its open and closed conditions, and the splicer further comprises scissor means arranged for severing broken ends of threads being spliced during the operation of the splicer, said scissor means being mounted immediately behind the splicing chamber and the latter being movable towards or away from the scissor means so as to vary the length of the threads attached and adjacent to the splice which operation of the device provides.

5. A pneumatic splicer according to claim 4 wherein the surface having the slot forming the splicing chamber comprises the surface of an elongate, axially rotatable, screw threaded member which is screwed into a correspondingly screw threaded aperture in said first body.

6. A pneumatic splicer according to claim 5 wherein there is provided a sleeve mounted on said first body in which the rotatable screw threaded member is mounted and wherein said scissor means comprises a pair of centrally pivoted members mounted on the sleeve which acts as a pivot, each said member having a blade at each end, the blade at one end of the member co-operating with a corresponding blade on one end of the other member to form a first pair of scissors and the blade on the other end of said one member co-operating with another corresponding blade on the other member so as to form a second pair of scissors, said scissors being disposed in a plane parallel to the plane of the surface containing the slot, and wherein said splicer incorporates a manual operator for closing the splicing chamber and actuating a supply of air thereto, said manual operator comprising a lever having intermediate arms which extend therefrom to a position in which they are in an operational relation to the blades of the scissor means, said arm impinging on the scissor means to cause operation thereof when the lever is manually actuated.

7. A pneumatic yarn splicer according to claim 1 wherein the axis of the pivot and the longitudinal axis of the slot are parallel and the said face of said first one of the bodies is curved in the vertical plane to which the said axes of the pivot and the slot are normally disposed.

8. A pneumatic yarn splicer comprising first and second bodies having respective complementary surfaces for engagement in sliding contact with one another;

mounting means for mounting the bodies for relative movement between open and closed positions of the splicer, the mounting means maintaining said surfaces in sliding contact with one another during a portion of such movement, which surfaces co-operate so as to provide a pneumatic splicing chamber which is open in said open condition and closed in said closed condition, said chamber being defined by a slot which is open at each end in said surface of the first body and a closure surface on the complementary surface of the second body;

and air supply means, including air passage means and an orifice in one of said bodies, arranged so as to admit air under pressure into the said splicing chamber when said chamber is closed.

9. A pneumatic yarn splicer according to claim 8 having said passage means and said orifice in said second body.

10. A pneumatic yarn splicer according to claim 9 wherein said mounting means includes a blast chamber defined by a bore in said second body, and said closure surface is provided by the crown of a piston which is a sliding fit in said bore, and wherein during a first phase of operation of the splicer, air is admitted into the blast chamber from an air supply means so as to force the piston into contact with the said surface of the first body containing the slot, and during a second phase of operation a blast of air is admitted to the blast chamber, which is exhausted through the said orifice into the slot.

11. A pneumatic yarn splicer according to claim 10 wherein the mounting means maintains the first and second bodies biased apart and includes a pneumatic valve in said second body having actuating means which co-operates with a manual operator, the latter when operated causing air to be admitted to the blast chamber and also acting through resilient means on the second body so as to close the splicing chamber.

12. A pneumatic yarn splicer according to claim 11 further comprising scissor means positioned behind the splicing chamber relative to said second body which include scissor blades on each side of the splicing chamber for cutting the broken ends of the yarns being spliced in the splicer and wherein said manual operator incorporates members which actuate the scissors means during a splicing operation.

* * * * *